US006170977B1

(12) United States Patent
Yakushiji

(10) Patent No.: US 6,170,977 B1
(45) Date of Patent: Jan. 9, 2001

(54) METHOD AND DEVICE FOR STIRRING A DEVELOPING LIQUID STORED IN AN IMAGE FORMING APPARATUS

(75) Inventor: Toru Yakushiji, Niigata (JP)

(73) Assignee: NEC Corporation, Tokyo (JP)

( * ) Notice: Under 35 U.S.C. 154(b), the term of this patent shall be extended for 0 days.

(21) Appl. No.: 09/335,362

(22) Filed: Jun. 17, 1999

(30) Foreign Application Priority Data

Jun. 19, 1998 (JP) ..... 10-173485

(51) Int. Cl.[7] ..... B01F 15/02

(52) U.S. Cl. ..... 366/136; 366/137; 366/182.2; 366/182.4

(58) Field of Search ..... 366/136, 137, 366/182.1, 182.2, 182.4

(56) References Cited

U.S. PATENT DOCUMENTS

| | | | | |
|---|---|---|---|---|
| 3,244,407 | * | 4/1966 | Obergfell et al. | 366/136 |
| 3,591,147 | * | 7/1971 | Anderson et al. | 366/136 |
| 4,664,528 | * | 5/1987 | Rodgers et al. | 366/137 |
| 4,764,019 | * | 8/1988 | Kaminski et al. | 366/136 |
| 4,857,355 | * | 8/1989 | Gregg | 366/136 |
| 4,863,277 | * | 9/1989 | Neal et al. | 366/136 |
| 4,893,937 | * | 1/1990 | Braun | 366/136 |
| 6,007,235 | * | 12/1999 | Freud et al. | 366/136 |

FOREIGN PATENT DOCUMENTS

| | | | | |
|---|---|---|---|---|
| 550642 | * | 9/1956 | (BE) | 366/136 |
| 5-79559 | | 10/1993 | (JP) . | |
| 6-19269 | | 1/1994 | (JP) . | |
| 6-95333 | | 4/1994 | (JP) . | |
| 6-138624 | | 5/1994 | (JP) . | |
| 7-334004 | | 12/1995 | (JP) . | |
| 8-114904 | | 5/1996 | (JP) . | |

* cited by examiner

*Primary Examiner*—Tony G. Soohoo
(74) *Attorney, Agent, or Firm*—Ostrolenk, Faber, Gerb & Soffen, LLP

(57) ABSTRACT

In an image forming apparatus operable with a developing liquid consisting of a solvent and toner particles dispersed therein, a device for stirring the liquid includes a reservoir formed with an inlet and an outlet for causing the liquid to be circulated therethrough. A pump delivers the developing liquid from the reservoir to the developing unit. A conduit causes the developing liquid fed from the reservoir to return to the reservoir via the pump and developing unit. The conduit forms a circulation path for preventing the toner particles of the developing liquid from depositing in the reservoir.

13 Claims, 2 Drawing Sheets

METHOD AND DEVICE FOR STIRRING A DEVELOPING LIQUID STORED IN AN IMAGE FORMING APPARATUS

BACKGROUND OF THE INVENTION

The present invention relates to an image forming apparatus of the type using a developing liquid and more particularly to a method and a device for stirring the developing liquid.

A developing liquid applicable to an image forming apparatus of the type described consists of a solvent and toner particles dispersed therein. The image forming apparatus includes a device for stirring the developing liquid stored in a reservoir. The prerequisite with the developing liquid is that the toner particles be uniformly dispersed in the solvent at all times. However, the toner particles have greater specific gravity than the solvent and consequently precipitate in the reservoir with the elapse of time. The toner particles deposited on the bottom of the reservoir render the density of the developing liquid non-uniform both in the reservoir and a developing unit to which the liquid is fed for development. An image printed on a paper or similar recording medium by such a developing liquid has irregular density and therefore poor quality. A key to high image quality is therefore to maintain the density of the developing liquid in the reservoir uniform.

It is a common practice with the above image forming apparatus to arrange a stirrer in the reservoir. The stirrer is rotatable to stir the toner particles of the developing liquid in the reservoir so as to maintain the density of the liquid constant. Specifically, a motor has its output shaft extended to a position close to the bottom of the reservoir. A blade for stirring the developing liquid is mounted on the end of the output shaft adjoining the reservoir. The blade stirs the developing liquid in the reservoir by being rotated by the motor.

The problem with the conventional blade scheme is that a single blade must be assigned to each of a plurality of reservoirs each storing a developing liquid of particular color, increasing the cost of the apparatus. In light of this, a mechanism including gears and shafts may be connected to a single motor so as to distribute the output torque of the motor to a plurality of stirrers. With this mechanism, it is possible to reduce the cost to a certain degree.

Japanese Patent Laid-Open Publication No. 6-19269, for example, teaches a simple and economical device for feeding a developing liquid. The device taught in this document, however, has some problems left unsolved, as follows. First, a single motor or drive source cannot drive all of a plurality of reservoirs alone, depending on the configuration of an image forming apparatus and the position of the individual reservoir. Second, an extra space is necessary for accommodating shafts connected to the stirrers of the reservoirs. Third, the configuration of the individual reservoir and that of the individual stirrer or blade are limited because they must prevent the developing liquid from settling in the associated reservoir. Fourth, each reservoir must be formed with a hole for passing the shaft for rotating the stirrer disposed thereon, so that the air-tightness of the reservoir is lowered. Particularly, impurities are apt to enter the reservoir via the hole while the developing liquid is apt to leak via the hole.

Technologies relating to the present invention are also disclosed in, e.g., Japanese Patent Laid-Open Publication Nos. 5-79559, 6-95333, 6-138624, 8-114904, and 7-334004.

SUMMARY OF THE INVENTION

It is therefore an object of the present invention to provide a developer stirring method capable of maintaining the density of a developing liquid stored in an image forming apparatus uniform by using a pump serving to feed the liquid to a developing unit, and a device for practicing the same.

In an image forming apparatus operable with a developing liquid consisting of a solvent and toner particles dispersed therein, a device for stirring the liquid of the present invention includes a reservoir formed with an inlet and an out let for causing the liquid to be circulated therethrough. A pump delivers the developing liquid from the reservoir to the developing unit. A conduit causes the developing liquid fed from the reservoir to return to the reservoir via the pump and developing unit. The conduit forms a circulation path for preventing the toner particles of the developing liquid from depositing in the reservoir.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
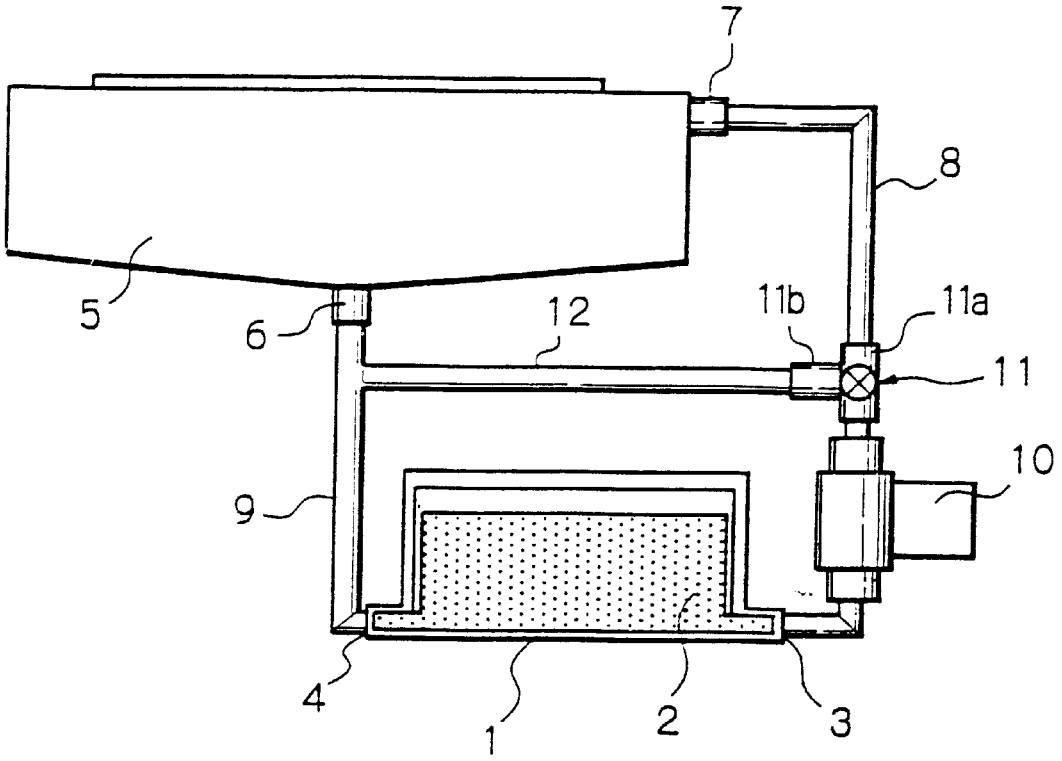
FIG. 1 is a view showing a developing device including a developer stirring device embodying the present invention.

Referring to FIG. 1 of the drawings, a developing device including a developer stirring device embodying the present invention is shown. As shown, the developing device includes a reservoir or tank 1 storing a developing liquid (simply liquid hereinafter) 2. The reservoir 1 is formed with an outlet 3 and an inlet 4 for circulating the liquid 2. A developing unit 5 is positioned above the reservoir 1 and formed with an inlet 7 and an outlet 6. The liquid 2 is fed into the developing unit 5 via the inlet 7 and discharged from the same via the outlet 6. Two conduits 8 and 9 provide communication between the reservoir 1 and the developing unit 5.

A pump 10 is included in the conduit 8 connecting the outlet 3 of the reservoir 1 to the inlet 7 of the developing unit 5 for feeding the liquid 2 from the reservoir 1 to the developing unit 5. Also included in the conduit 8 is a two-way valve 11 for selectively delivering the liquid 2 fed from the reservoir 1 to the developing unit 5 or returning it to the reservoir 1. Specifically, the two-way valve 11 includes a pipe portion 11*a* for delivering the liquid 2 to the inlet 7 of the developing unit 5 via the conduit 8 and a pipe portion 11*b* for returning it to the inlet 4 of the reservoir 1 via a conduit 12 and the conduit 9. A controller, not shown, causes the two-way valve 11 to select either one of its pipe portions 11*a* and 11*b*.

Figure 2:
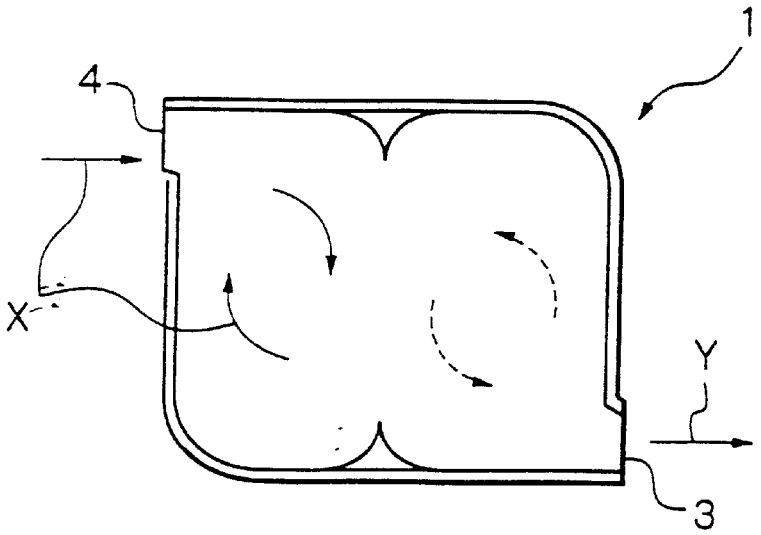
FIG. 2 is a sectional plan view showing a specific configuration of a reservoir included in the illustrative embodiment.

FIG. 2 shows a specific configuration of the reservoir 1 in a sectional plan view. As shown, the liquid 2 flows in the reservoir 1 in a direction X due to the feed via the inlet 4 and flows in a direction Y due to the delivery via the outlet 3. The reservoir 1 should preferably be configured to allow the liquid 2 to flow smoothly without settling at the end portions of the reservoir 1, taking account of the above flows X and Y.

Figure 3:
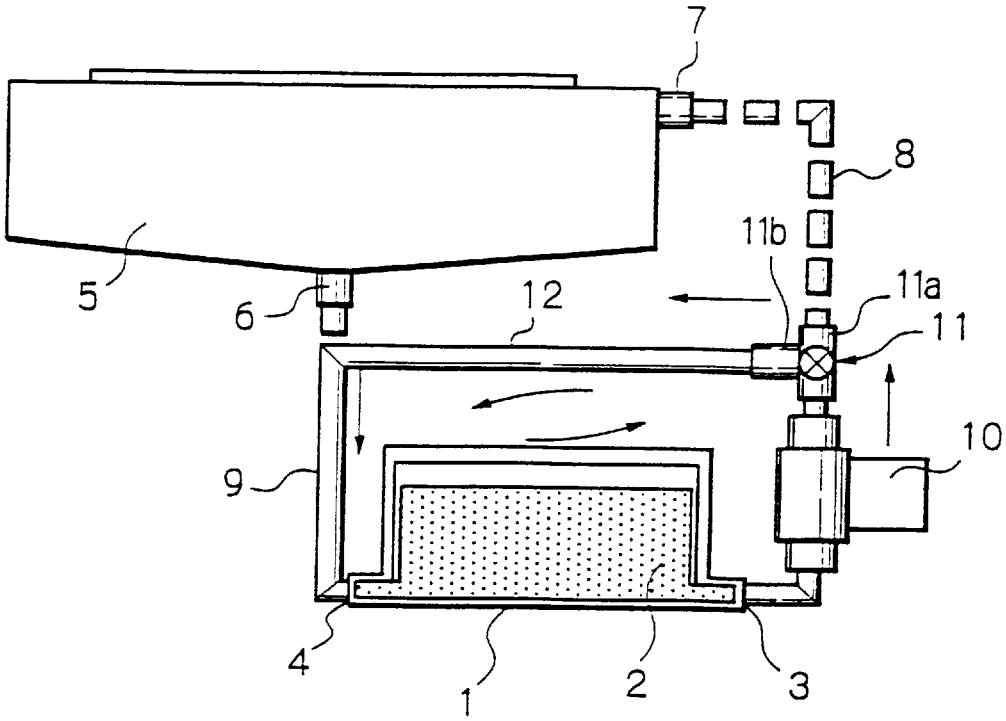
FIGS. 3 and 4 are views demonstrating the operation of the illustrative embodiment.
Figure 4:
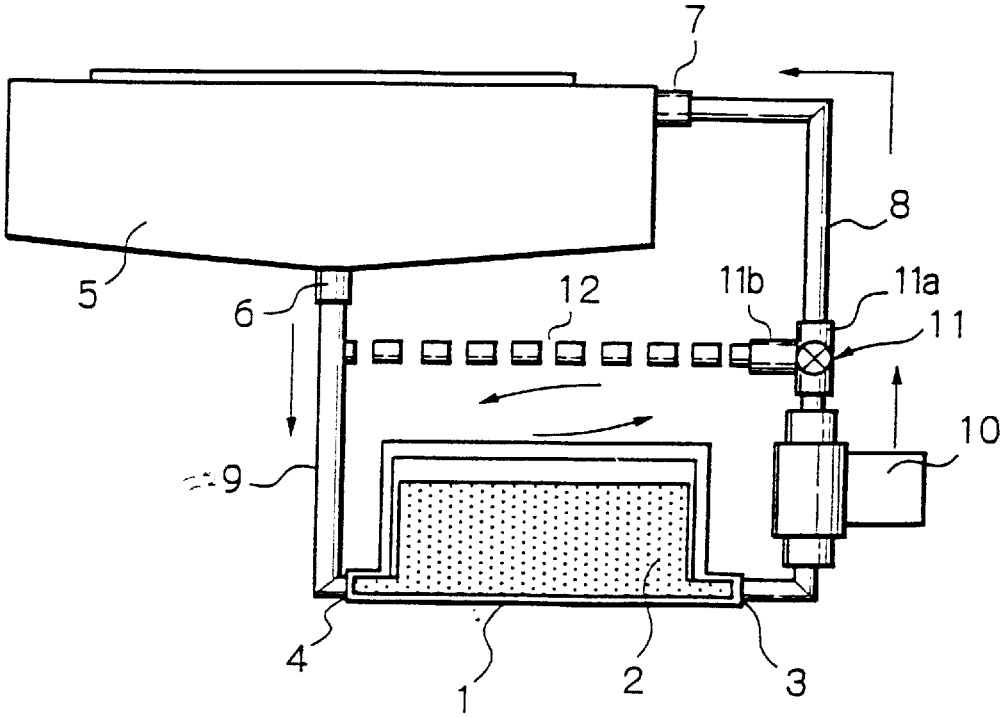

Reference will be made to FIGS. 3 and 4 for describing how the liquid 2 is circulated in the illustrative embodiment.

Usually, the liquid 2 should be circulated through the developing unit 5 only during the formation of an image on a paper. That is, the liquid 2 does not have to be fed to the developing unit 5 when the apparatus is a stand-by state.

As shown in FIG. 3, while the apparatus is in a stand-by state, the controller causes the two-way valve 11 to select its pipe portion 11*b*, i.e., to prevent the liquid 2 from flowing to the developing unit 5 via the pipe portion 11*a* and conduit 8. In this condition, when the pump 10 is driven, it causes the liquid 2 to flow from of the tank 1 toward the developing unit 5 via the outlet 3. However, the two-way valve 9 steers the liquid 2 to the inlet 4 of the reservoir 1 via the conduits 12 and 9.

When the apparatus forms an image on a paper, the controller switches the two-way valve 11 such that the liquid 2 flows form the reservoir 1 to the developing unit 5 via the valve 11. Excess part of the liquid 2 circulated through the developing unit 5 for development is returned to the reservoir 1 via the conduit 9.

When the apparatus is again brought into its stand-by state after the above image formation, the controller again switches the two-way valve 11 such that the liquid 2 does not flow to the developing unit 5. As a result, the liquid 2 flowing out of the tank 1 is returned to the tank 1 via the pump 10, valve 11, and conduits 12 and 9.

As stated above, when the apparatus is in the stand-by state, the liquid 2 constantly flows from the reservoir 1 to the reservoir 1 via the two-way valve 11 and conduits 12 and 9. Such a flow of the liquid 2 itself prevents toner particles dispersed in the liquid 2 from precipitating in the reservoir 1.

Even during image formation, excess part of the liquid 2 passed through the developing unit 5 is returned to the reservoir 1. The liquid 2 is therefore successfully circulated through the pump 10, two-way valve 11, developing unit 5, and conduit 9. In addition, the liquid 2 is prevented from staying in the reservoir 1. Of course, the liquid 2 is stirred during image formation in the same manner as in the stand-by state.

Because the liquid 2 is circulated in one direction from the developing unit 5 to the reservoir 1, the toner particles may happen to stay around the outlet 3 of the reservoir 1. In light of this, as seen in FIG. 3, the pump 10 may be so operated as to reverse the flow of the liquid 2 in the stand-by state of the apparatus.

Further, the drive of the pump 10 and the switching of the two-way valve 11 cooperate to stir the liquid 2 at all times. This prevents the toner particles of the liquid 2 from precipitating in the reservoir 1 and thereby insures the uniform density of the liquid 2 without resorting to extra stirring means. In addition, the reservoir 1 is fully air-tight because it is not communicated to the atmosphere at all.

In the above embodiment, the liquid 2 is prevented from flowing to the developing unit 5 except when the apparatus forms an image. Alternatively, the ink 2 may be fed to the developing unit 5 even during image formation, depending on the configuration of the unit 5. Specifically, the developing unit 5 may be provided with a structure allowing the liquid 2 to be constantly circulated therethrough.

Various modifications will become possible for those skilled in the art after receiving the teachings of the present disclosure without departing from the scope thereof.

What is claimed is:

1. A device for stirring a developing liquid comprised of a solvent and toner particles dispersed in the solvent, and for feeding the stirred liquid to a developing unit in an image forming apparatus, the device comprising:

a liquid reservoir;

a main conduit system having a first leg connected to deliver developing liquid from the reservoir to the developing unit, and a second leg for returning unused developing liquid from the developing unit to the reservoir;

a reversible pump connected in the main conduit system to circulate the developing liquid;

a bypass device connected between the first and second legs of the main conduit system which provides a first flow path from the reservoir to the developing unit when the developing device requires developing liquid, and a second flow path into and out of the reservoir when developing liquid is not being used by the developing unit, thereby preventing the toner particles from settling out of the developing liquid in the reservoir; and a pump controller which selectively allows the flow direction through the pump to be reversed.

2. A device according to claim 1, wherein the bypass device comprises:

a bypass conduit having a first end directly connected to the first leg of the main conduit system;

a diverter mechanism connecting a second end of the bypass conduit to the second leg of the main conduit system; and a controller for the diverter mechanism operative to block flow of developing liquid to the bypass conduit when developing liquid is required by the developing unit and to permit flow of developing liquid to the bypass conduit while blocking flow of developing liquid to the developing unit when it is not required.

3. A device according to claim 1, wherein the pump is operative to circulate liquid in a first direction which carries developing liquid from the reservoir through the main conduit system to the developing unit and to circulate liquid in a second direction which is opposite to the first direction; and wherein the pump controller operates the pump in the second direction only when developing liquid is flowing through the bypass device.

4. A device according to claim 1, wherein the bypass device includes:

a bypass conduit having a first end directly connected to one leg of the main conduit system;

a two-way valve which connects a second end of the bypass device to the second leg of the main conduit system, and provides a first flow path through the main conduit system between the reservoir and the developing device while blocking liquid flow through the bypass conduit, and a second flow path through the bypass conduit while blocking liquid flow between the reservoir and the developing device; and a controller for selecting between the first and second flow paths for the two-way valve.

5. A device according to claim 4, wherein the pump is operative to circulate liquid in a first direction which carries developing liquid from the reservoir through the main conduit system to the developing device and to circulate liquid in a second direction which is opposite to the first direction; and wherein the pump controller operates the pump in the second direction only when developing liquid is flowing through the bypass device.

6. A device according to claim 1, wherein the reservoir is comprised of an air-tight container with first and second ports at the bottom thereof, the first and second ports being connected respectively to the first and second legs of the main conduit system.

7. A device according to claim 6, wherein the bypass device includes:

a bypass conduit having a first end directly connected to the first leg of the main conduit system;

a two-way valve which connects a second end of the bypass conduit to the second leg of the main conduit system, and provides a first flow path through the main conduit system between the reservoir and the developing unit while blocking liquid flow through the bypass conduit, and a second flow path through the bypass conduit while blocking liquid flow between the reservoir and the developing unit; wherein the controller opens the first flow path for the two-way valve when developing liquid is required by the developing unit and opens the second flow path for the two-way valve when developing liquid is not required by the developing unit; wherein the pump is located in the second leg of the main conduit system between the second port in the reservoir and the two-way valve; wherein the pump is operative to circulate liquid in a first direction from the second port in the reservoir through the second leg of the main conduit system to the developing unit and to circulate liquid in a second direction through the second leg of the main conduit from the two-way valve to the second port in the reservoir; and wherein the pump controller operates the pump in the second direction only when the second flow path of the two-way valve is open.

8. A distribution system for liquid comprised of a solvent with particles dispersed therein, the system comprising:

a reservoir for the liquid;

a utilization device;

a main conduit system having a first leg connected to deliver the liquid from the reservoir to the utilization device and a second leg for returning unused liquid from the utilization device to the reservoir;

a pump connected in the conduit system to circulate the liquid;

a by-pass device connected between the first and second legs of the main conduit system which provides a first flow path from the reservoir to the utilization device when the utilization device requires the liquid, and a second circulation path for the liquid into and out of the reservoir when the liquid is not required by the utilization device thereby preventing the particles from settling out of the liquid in the reservoir; and a pump controller which selectively allows the flow direction through the pump to be reversed.

9. A device according to claim 8, wherein the bypass device comprises:

a bypass conduit having a first end directly connected to one leg of the main conduit system;

a diverter mechanism connecting a second end of the bypass conduit to the second leg of the main conduit system; and a controller for the diverter mechanism operative to block flow of liquid to the bypass conduit when the liquid is required by the utilization device and to permit flow of liquid to the bypass conduit while blocking flow of liquid to the utilization device at other times.

10. A device according to claim 8, wherein the pump is operative to circulate liquid in a first direction which carries liquid from the reservoir through the main conduit system to the utilization device and to circulate liquid in a second direction which is opposite to the first direction; and wherein the pump controller operates the pump in the second direction only when liquid is flowing through the bypass device.

11. A device according to claim 8, wherein the reservoir is comprised of an air-tight container with first and second ports at the bottom thereof, the first and second ports being connected respectively to the first and second legs of the main conduit system, wherein:

the bypass device includes:

a bypass conduit having a first end directly connected to the first leg of the main conduit system;

a two-way valve which connects a second end of the bypass conduit to the second leg of the main conduit system, and provides a first flow path through the main conduit system between the reservoir and the utilization device while blocking liquid flow through the bypass conduit, and a second flow path through the bypass conduit while blocking liquid flow between the reservoir and the developing device; and wherein the controller opens the first flow path for the two-way valve when liquid is required by the utilization device and opens the second flow path for the two-way valve when liquid is not required by the utilization device; wherein the pump is located in the second leg of the main conduit system between the second access port in the reservoir and the two-way valve; wherein the pump is operative to circulate liquid in a first direction from the second port in the reservoir through the second leg of the main conduit system to the utilization device and to circulate liquid in a second direction through the second leg of the main conduit from the two-way valve to the second port in the reservoir; and wherein the pump controller operates the pump in the second flow direction only when the second flow path of the two-way valve is open.

12. A method for stirring a developing liquid comprised of a solvent and toner particles dispersed in the solvent, and for feeding the stirred liquid to a developing unit in an image forming apparatus, the method comprising:

storing the developing liquid in a liquid reservoir;

circulating the developing liquid through a main conduit system to the developing unit;

returning unused developing liquid from the developing unit to the reservoir through the conduit system;

diverting the circulating developing liquid through a bypass device to prevent flow of the developing liquid into and out of the developing unit when the developing liquid is not required by the developing unit, while continuing to circulate the developing liquid out of and back to the reservoir, thereby preventing the toner particles from settling out of the developing liquid in the reservoir when it is not in use; and selectively reversing the direction of circulation of the developing liquid.

13. A device according to claim 12, wherein the developing liquid is circulated in a first direction which carries it from the reservoir to the developing device when developing liquid is required by the developing unit, or in a second direction which is opposite to the first direction; and wherein the developing liquid is circulated in the second flow direction only when the developing liquid is being diverted to the bypass device.

* * * * *